US012358688B2

(12) United States Patent
Adsit

(10) Patent No.: US 12,358,688 B2
(45) Date of Patent: Jul. 15, 2025

(54) REFLECTIVE ALCOHOL CONTAINER DEVICE

(71) Applicant: John Adsit, Oswego, KS (US)

(72) Inventor: John Adsit, Oswego, KS (US)

( * ) Notice: Subject to any disclaimer, the term of this patent is extended or adjusted under 35 U.S.C. 154(b) by 59 days.

(21) Appl. No.: 18/386,688

(22) Filed: Nov. 3, 2023

(65) Prior Publication Data

US 2025/0145334 A1 May 8, 2025

(51) Int. Cl.
*B65D 25/20* (2006.01)
*B65D 23/08* (2006.01)
*B65D 23/14* (2006.01)

(52) U.S. Cl.
CPC ..... *B65D 25/205* (2013.01); *B65D 23/08* (2013.01); *B65D 23/14* (2013.01); *B65D 2203/12* (2013.01)

(58) Field of Classification Search
CPC .... B65D 2203/12; B65D 23/14; B65D 23/08; B65D 25/205
USPC ..... 215/366
See application file for complete search history.

(56) References Cited

U.S. PATENT DOCUMENTS 1,995,306 A * 3/1935 Hesson ..... B65C 3/12 156/364
2,810,978 A * 10/1957 Chapman ..... B65D 23/14 428/912.2
6,105,814 A 8/2000 Chen
6,755,314 B2 6/2004 Cooper
6,971,759 B2 * 12/2005 Sutton ..... A47G 19/2227 362/101
7,300,171 B2 * 11/2007 Sutton ..... A45C 13/02 215/390
8,100,278 B2 1/2012 Dlouhy
9,271,945 B2 * 3/2016 Hurley ..... A61K 31/445
D850,291 S 6/2019 Bidzinashvili
10,591,138 B1 * 3/2020 Blackdiamond ..... B01F 27/80
D897,848 S 10/2020 Milani
2005/0056203 A1 * 3/2005 Giewercer ..... G09F 3/00 116/308
2005/0224448 A1 * 10/2005 Sutton ..... A47G 19/2266 215/386
2006/0144739 A1 * 7/2006 Tsai ..... A45D 33/006 206/459.5
2008/0034627 A1 * 2/2008 Schnuckle ..... G09F 19/12 40/306
2010/0163516 A1 * 7/2010 Paine ..... B65D 23/12 215/386
2012/0060746 A1 * 3/2012 Mandelbaum ..... B62J 6/26 116/28 R (Continued)

FOREIGN PATENT DOCUMENTS

WO WO2008025301 3/2008

*Primary Examiner* — Ernesto A Grano

(57) ABSTRACT

A reflective alcohol container device for visually indicating when a driver of a vehicle is consuming an alcoholic beverage includes an alcoholic beverage container which contains an alcoholic beverage. A reflector is applied to the alcoholic beverage container and the reflector is substantially comprised of a light reflecting material to reflect light. The reflector is exposed when the alcoholic beverage container is tipped for drinking. In this way the reflector can reflect the light from headlights of oncoming traffic when a driver of a vehicle is drinking and driving. In this way oncoming drivers and police can be visually alerted that the driver is drinking and driving.

4 Claims, 7 Drawing Sheets

(56) References Cited

U.S. PATENT DOCUMENTS

| | | | | |
|---|---|---|---|---|
| 2014/0055275 | A1* | 2/2014 | Lien | G01S 17/02 215/386 |
| 2019/0202611 | A1* | 7/2019 | Duarte Da Cal | B65D 51/248 |
| 2021/0009315 | A1* | 1/2021 | Huang | B65D 25/22 |
| 2022/0074585 | A1 | 3/2022 | Hintz | |

* cited by examiner

REFLECTIVE ALCOHOL CONTAINER DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to alcohol container devices and more particularly pertains to a new alcohol container devices for when a driver of a vehicle is consuming an alcoholic beverage. The device includes an alcoholic beverage container and a reflector attached to a bottom of the alcoholic beverage container which reflects light from headlights of oncoming traffic when the alcoholic beverage container is tipped by a driver in a vehicle to drink from the alcoholic beverage container.

(2) Description of Related Art Including Information Disclosed under 37 CFR 1.97 and 1.98

The prior art relates to alcohol container devices including a variety of beverage bottle illumination devices that each employs various means is emitting light into a beverage bottle to enhance the ornamental appeal of the beverage bottle. In no instance does the prior art disclose an alcoholic beverage container device that has a reflector attached to a bottom of an alcoholic beverage container for reflecting light from headlights of oncoming traffic when the alcoholic beverage container is tipped for consuming contents of the alcoholic beverage container by a driver of a vehicle.

BRIEF SUMMARY OF THE INVENTION

An embodiment of the disclosure meets the needs presented above by generally comprising an alcoholic beverage container which contains an alcoholic beverage. A reflector is applied to the alcoholic beverage container and the reflector is substantially comprised of a light reflecting material to reflect light. The reflector is exposed when the alcoholic beverage container is tipped for drinking. In this way the reflector can reflect the light from headlights of oncoming traffic when a driver of a vehicle is drinking and driving. In this way oncoming drivers and police can be visually alerted that the driver is drinking and driving.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
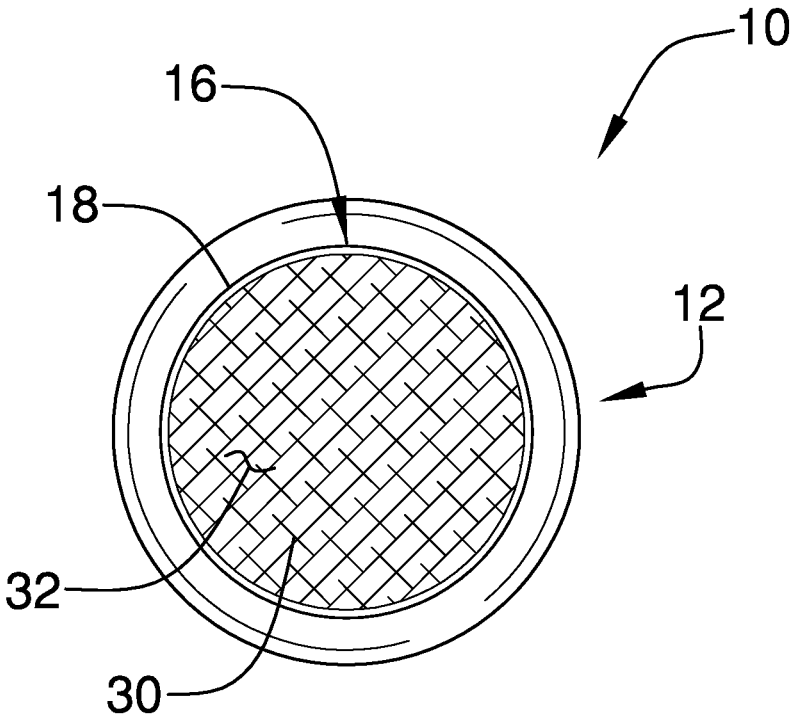
FIG. 1 is a bottom view of a reflective alcohol container device according to an embodiment of the disclosure showing a reflector attached to a cylindrical alcoholic beverage container.
Figure 2:
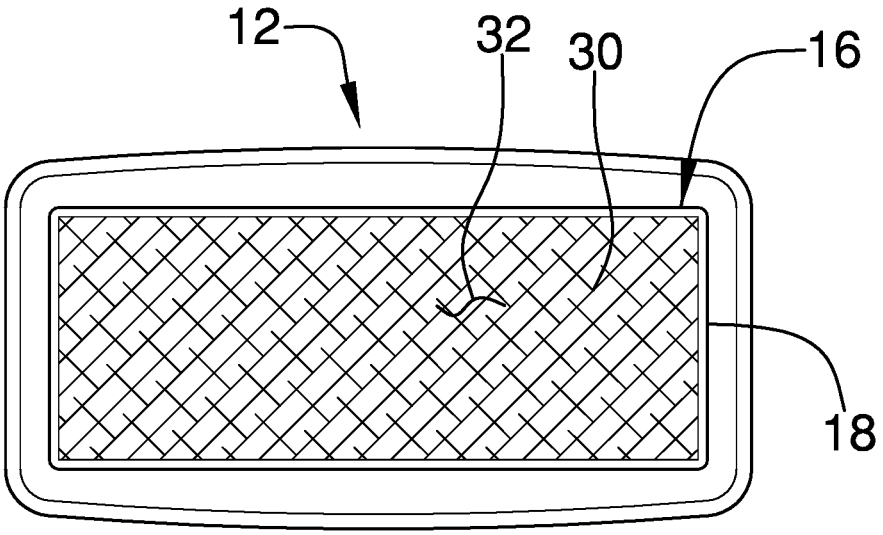
FIG. 2 is a bottom view of an embodiment of the disclosure showing a reflector being attached to a rectangular alcoholic beverage container.
Figure 3:
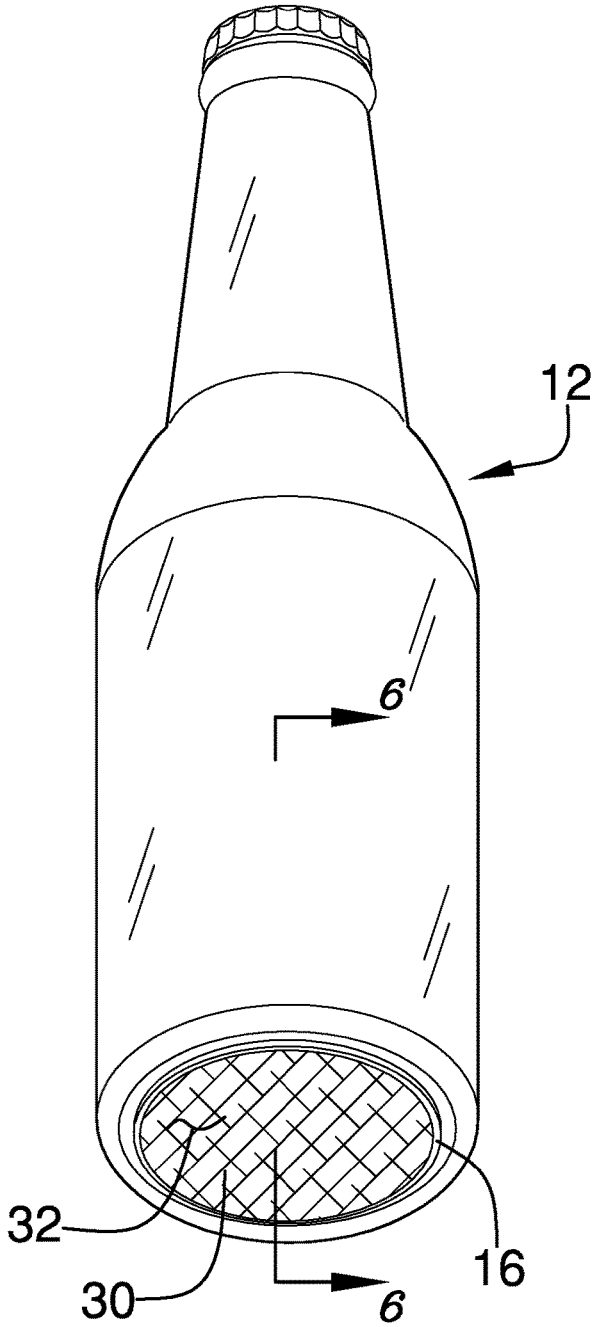
FIG. 3 is a bottom perspective view of an embodiment of the disclosure showing a reflector attached to a cylindrical bottle.
Figure 4:
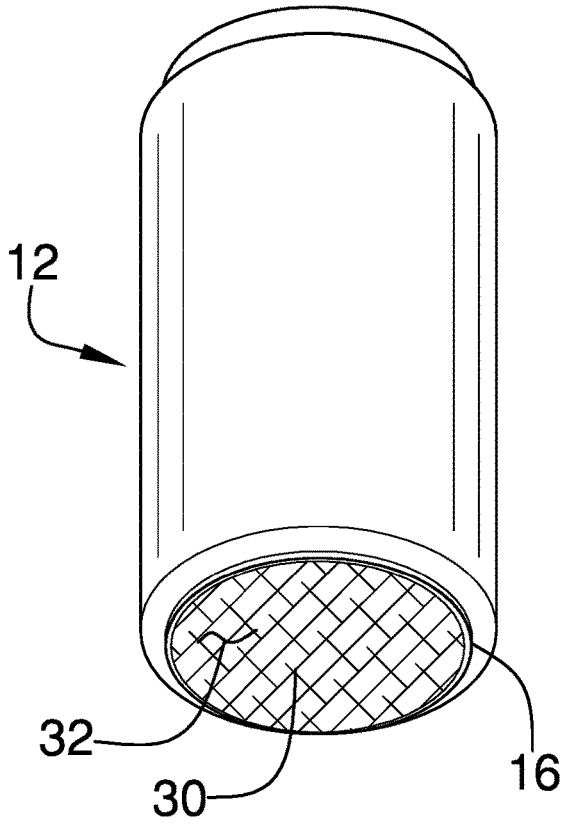
FIG. 4 is a bottom perspective view of an embodiment of the disclosure showing a reflector attached to a can.
Figure 5:
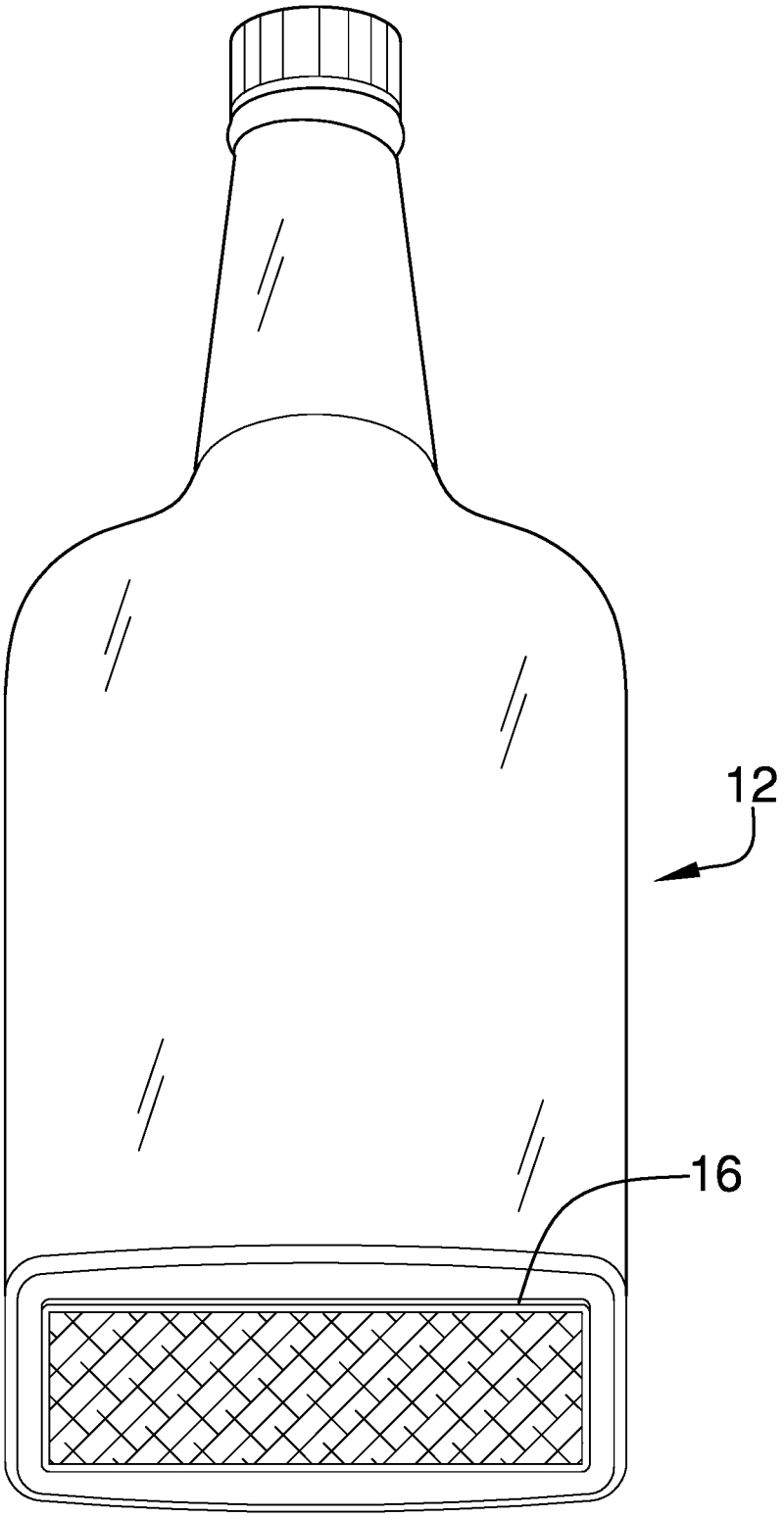
FIG. 5 is a bottom perspective view of an embodiment of the disclosure showing a reflector being attached to a rectangular bottle.
Figure 6:
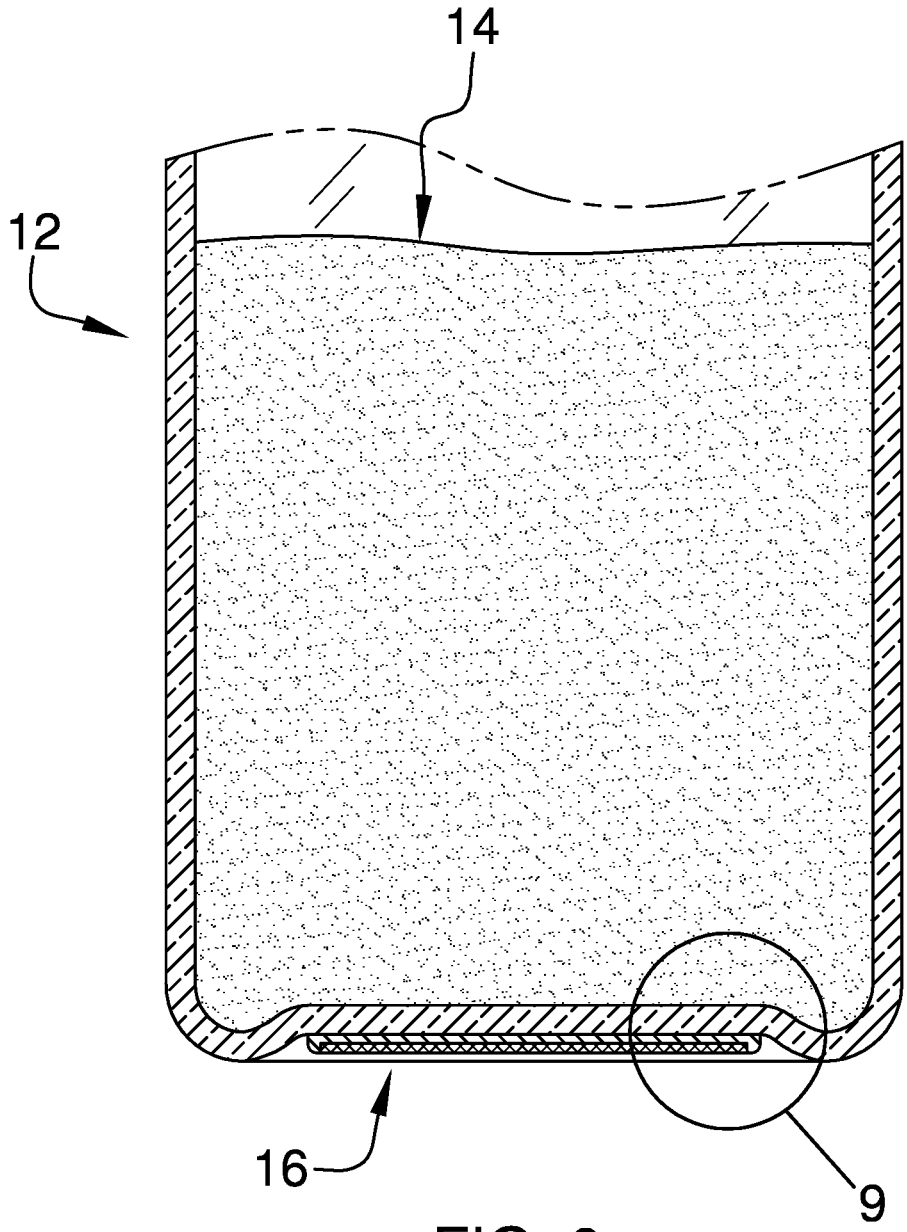
FIG. 6 is a cross sectional view taken along line 6-6 of FIG. 3 of an embodiment of the disclosure.
Figure 7:
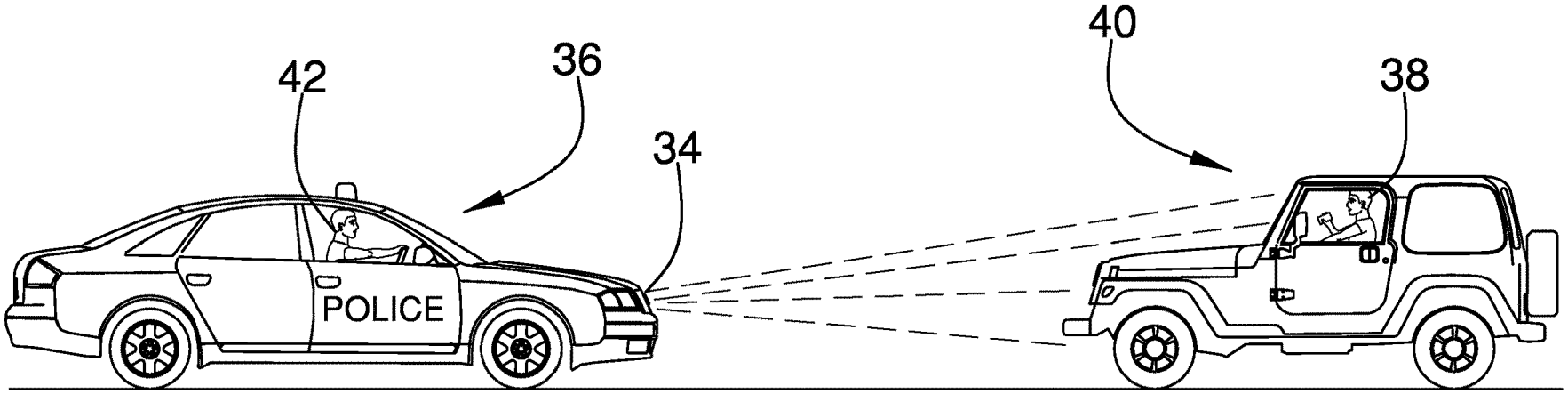
FIG. 7 is a perspective in-use view of an embodiment of the disclosure showing a first vehicle approaching a second vehicle on a roadway.
Figure 8:
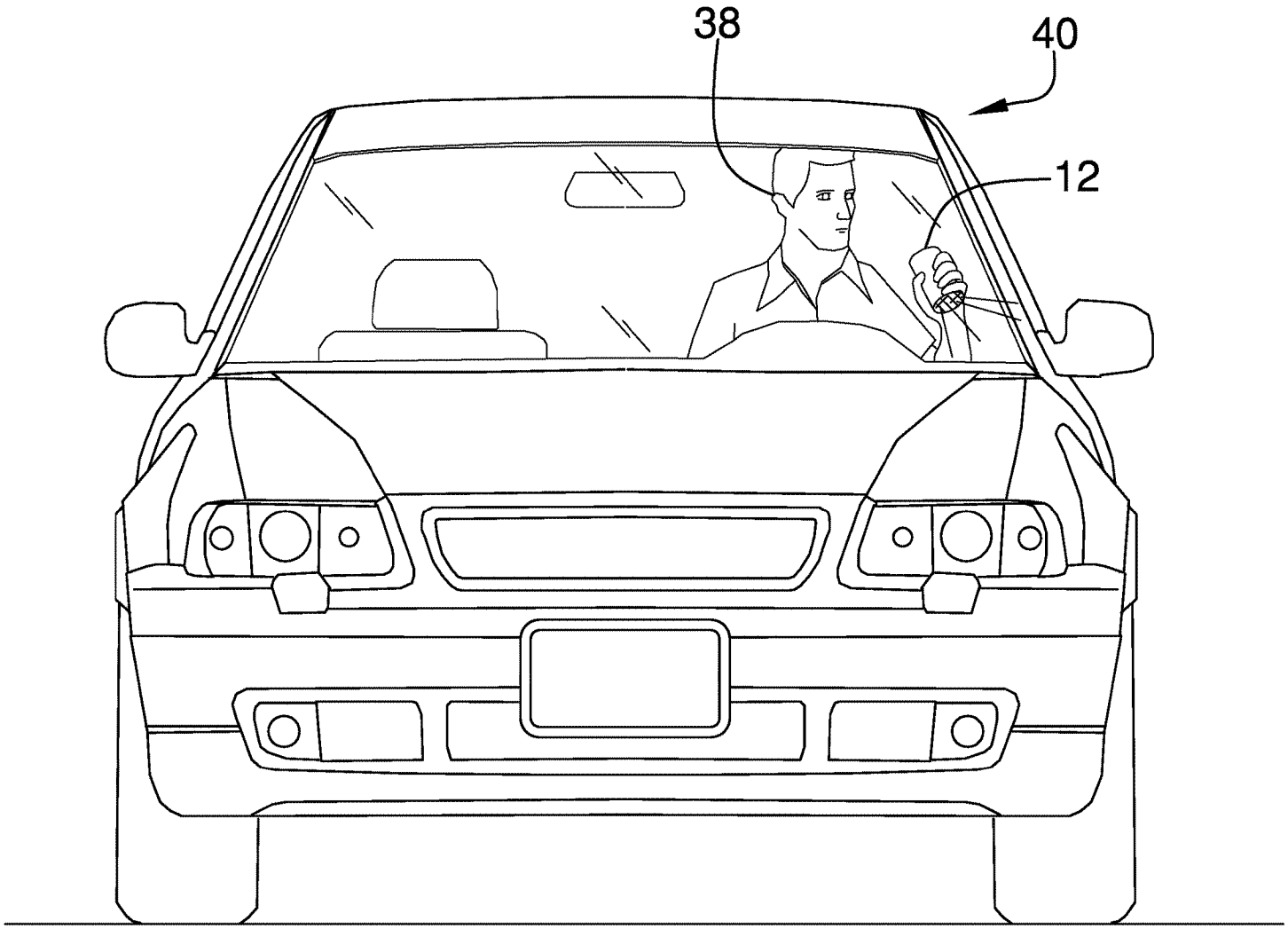
FIG. 8 is a perspective in-use view of an embodiment of the disclosure showing a driver of a vehicle tipping an alcoholic beverage container.
Figure 9:
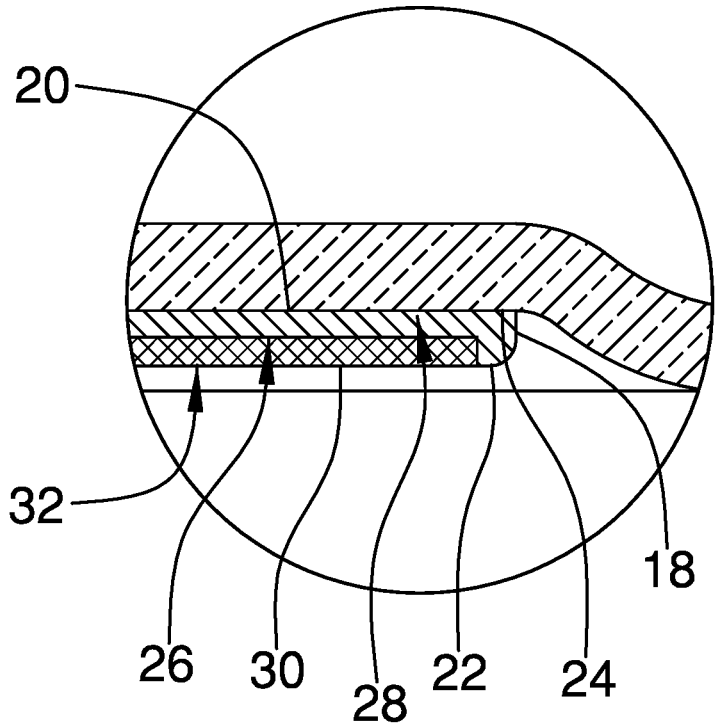
FIG. 9 is a magnified detail view taken from circle 9 of FIG. 6 of an embodiment of the disclosure.

With reference now to the drawings, and in particular to FIGS. 1 through 9 thereof, a new alcohol container devices embodying the principles and concepts of an embodiment of the disclosure and generally designated by the reference numeral 10 will be described.

As best illustrated in FIGS. 1 through 9, the reflective alcohol container device 10 generally comprises an alcoholic beverage container 12 that contains an alcoholic beverage 14. The alcoholic beverage container 12 may comprise a glass bottle, an aluminum can or any other type of container in which alcoholic beverages are commonly marketed for consumption. A reflector 16 is applied to the alcoholic beverage container 12 and the reflector 16 is substantially comprised of a light reflecting material for reflecting light. The reflector 16 is exposed when the alcoholic beverage container 12 is tipped for drinking thereby facilitating the reflector 16 to reflect the light from headlights of oncoming traffic when a driver of a vehicle is drinking and driving. In this way oncoming drivers, such as civilian motorists or police officers, are visually notified that the driver is drinking an alcoholic beverage 14 and driving.

The reflector 16 comprises an adhesive layer 18 that has a first surface 20 and a second surface 22; the first surface 20 is adhered to a bottom wall 24 of the alcoholic beverage container 12. The second surface 22 of the adhesive layer 18 has a recess 26 which extends toward the first surface 20. As is most clearly shown in FIGS. 6 and 9, the bottom wall 24 of the alcoholic beverage container 12 may have a recess 28 in which the adhesive layer 18 is positioned. The adhesive layer 18 may comprise a resilient adhesive which has sufficient adhesive strength to resist being removed by an end user thereby inhibiting tampering with the reflector 16.

The reflector 16 includes a reflective panel 30 which is secured in the recess 26 in the second surface 22 of the adhesive layer 18 such that an exposed surface 32 of the reflective panel 30 lies flush with the second surface 22 of the adhesive layer 18. The exposed surface 32 is directed forwardly when the alcoholic beverage container 12 is tipped while drinking from the alcoholic beverage container 12. Furthermore, the exposed surface 32 of the reflective panel 30 is comprised of a light reflecting material which may comply with the United States Department of Transportation regulations for reflective tape and signage. In this way the exposed surface 32 of the reflective panel 30 can reflect light from headlights of oncoming traffic at a sufficient intensity to be clearly visible to drivers of the oncoming traffic when the alcoholic beverage container 12 is tipped for drinking.

In use, the light emitted from headlights 34 of a first vehicle 36 is intensely reflected by the reflector 16 on the bottom wall 24 of the alcoholic beverage container 12 when a driver 38 of a second vehicle 40 tips the alcoholic beverage container 12 to drink from the alcoholic beverage container 12 while the first vehicle 36 is approaching the second vehicle 40 on a roadway. In this way the driver 42 of the first vehicle 36 is visually notified that the driver 38 of the second vehicle 40 is consuming an alcoholic beverage 14 while driving. Thus, the driver 42 of the first vehicle 36 can notify law enforcement to a potentially impaired driver operating a vehicle. Furthermore, law enforcement officers are facilitated to quickly and easily visually identify a driver that is consuming an alcoholic beverage 14 while the driver is operating a motor vehicle on a public roadway.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A reflective alcohol container device for reflecting light from oncoming headlights of a vehicle when a driver is drinking while driving thereby notifying other drivers and police that the driver is drinking alcohol while driving, said device comprising:

an alcoholic beverage container for marketing and sale of an alcoholic beverage;

the alcoholic beverage being positioned in said alcoholic beverage container for marketing and sale of the alcoholic beverage;

a reflector being applied to said alcoholic beverage container, said reflector being substantially comprised of a light reflecting material wherein said reflector is configured to reflect light, said reflector being exposed when said alcoholic beverage container is tipped for drinking wherein said reflector is configured to reflect the light from headlights of oncoming traffic when a driver of a vehicle is drinking and driving thereby visually alerting oncoming drivers and police that the driver is drinking and driving; and wherein said reflector comprises an adhesive layer having a first surface and a second surface, said first surface being adhered to a bottom wall of said alcoholic beverage container, said second surface having a recess extending toward said first surface.

2. The device according to claim 1, wherein said reflector includes a reflective panel being secured in said recess in said second surface of said adhesive layer such that an exposed surface of said reflective panel lies flush with said second surface of said adhesive layer.

3. The device according to claim 1, wherein:

said exposed surface is directed forwardly when said alcoholic beverage container is tipped while drinking from said alcoholic beverage container; and said exposed surface of said reflective panel is comprised of a light reflecting material wherein said exposed surface of said reflective panel is configured to reflect light from headlights of oncoming traffic when said alcoholic beverage container is tipped for drinking.

4. A reflective alcohol container device for reflecting light from oncoming headlights of a vehicle when a driver is drinking while driving thereby notifying other drivers and police that the driver is drinking alcohol while driving, said device comprising:

an alcoholic beverage container for marketing and sale of an alcoholic beverage;

the alcoholic beverage being positioned in said alcoholic beverage container for marketing and sale of the alcoholic beverage; and a reflector being applied to said alcoholic beverage container, said reflector being substantially comprised of a light reflecting material wherein said reflector is configured to reflect light, said reflector being exposed when said alcoholic beverage container is tipped for drinking wherein said reflector is configured to reflect the light from headlights of oncoming traffic when a driver of a vehicle is drinking and driving thereby visually alerting oncoming drivers and police that the driver is drinking and driving, said reflector comprising:

an adhesive layer having a first surface and a second surface, said first surface being adhered to a bottom wall of said alcoholic beverage container, said second surface having a recess extending toward said first surface; and a reflective panel being secured in said recess in said second surface of said adhesive layer such that an exposed surface of said reflective panel lies flush with said second surface of said adhesive layer, said exposed surface being directed forwardly when said alcoholic beverage container is tipped while drinking from said alcoholic beverage container, said exposed surface of said reflective panel being comprised of a light reflecting material wherein said exposed surface of said reflective panel is configured to reflect light from headlights of oncoming traffic when said alcoholic beverage container is tipped for drinking.

* * * * *